US007549610B1

(12) United States Patent
Ireland

(10) Patent No.: US 7,549,610 B1
(45) Date of Patent: Jun. 23, 2009

(54) CONTROL EXPANSION FOR CONVENTIONALLY POWERED MODEL RAILROADS

(75) Inventor: Anthony J. Ireland, Norcross, GA (US)

(73) Assignee: A. J. Ireland, Lynn Haven, FL (US)

( * ) Notice: Subject to any disclaimer, the term of this patent is extended or adjusted under 35 U.S.C. 154(b) by 604 days.

(21) Appl. No.: 11/314,935

(22) Filed: Dec. 21, 2005

(51) Int. Cl.
*B61L 7/00* (2006.01)

(52) U.S. Cl. ..... 246/1 C; 246/3; 246/187 A; 701/2; 701/19

(58) Field of Classification Search ..... 246/1 R, 246/1 C, 3, 115, 122 A, 187 A, 20, 34 CT, 246/117, 122 R, 167 R; 701/2, 19, 20; 318/280; 104/295, 296; 340/825.52
See application file for complete search history.

(56) References Cited

U.S. PATENT DOCUMENTS 5,773,939 A * 6/1998 Severson et al. ..... 318/51
5,896,017 A * 4/1999 Severson et al. ..... 312/280
6,179,105 B1 * 1/2001 Haass ..... 191/22 R
6,270,040 B1 * 8/2001 Katzer ..... 246/1 R
6,445,150 B1 * 9/2002 Tanner et al. ..... 318/280
6,457,681 B1 * 10/2002 Wolf et al. ..... 246/187 A
6,539,292 B1 * 3/2003 Ames, Jr. ..... 701/19
6,619,594 B2 * 9/2003 Wolf et al. ..... 246/187 A
6,655,640 B2 * 12/2003 Wolf et al. ..... 246/167 R
7,137,600 B2 * 11/2006 Lenz ..... 246/115
7,142,954 B2 * 11/2006 Neiser ..... 701/19
7,198,235 B2 * 4/2007 Lenz ..... 246/34 CT

* cited by examiner

*Primary Examiner*—Mark T Le

(57) ABSTRACT

A method and apparatus is shown to allow expanded control capability of digital locomotives on model railroad layouts that also permit compatible speed and direction operation simultaneously for non-digital or conventional locomotives alongside. The improvements employ mixed-mode control encoding and decoding algorithms and methods that are expanded beyond the prior art for control mode changes used on model railroad layouts.

19 Claims, 5 Drawing Sheets

Figure 3:
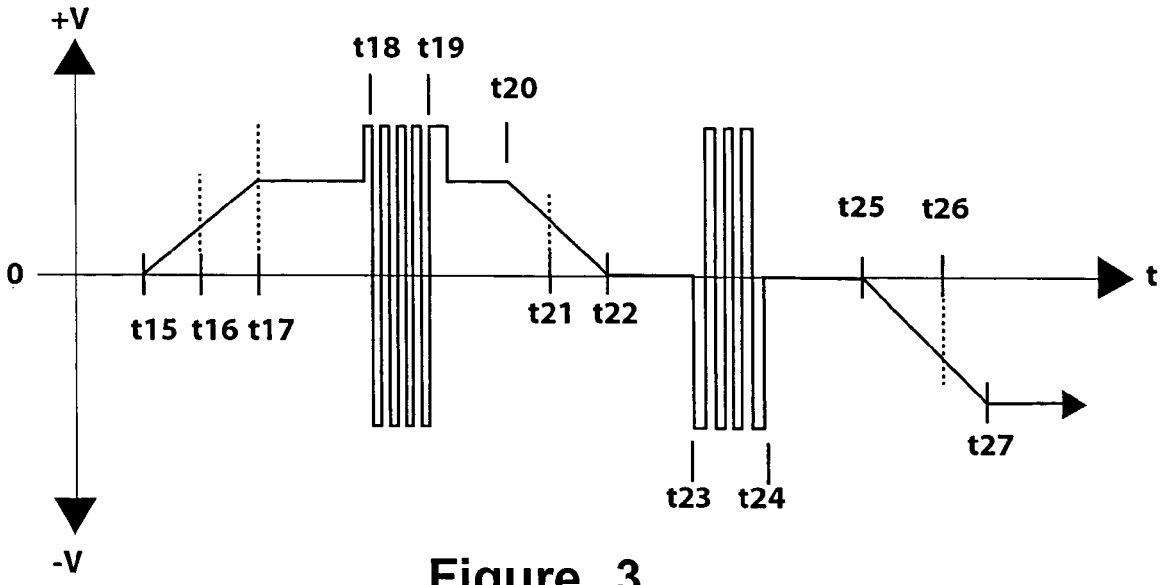

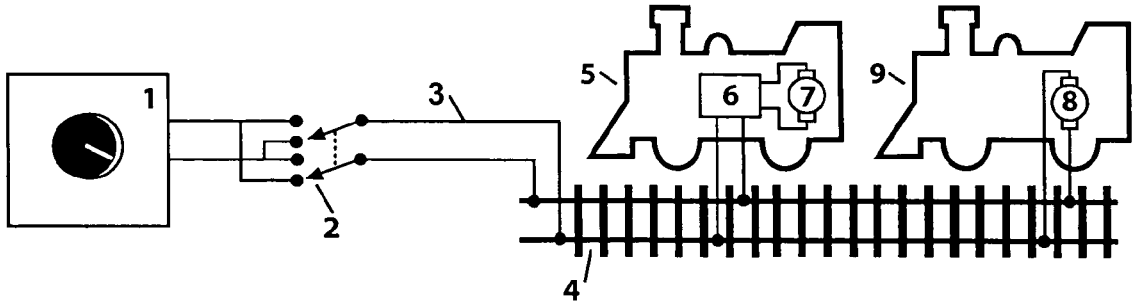
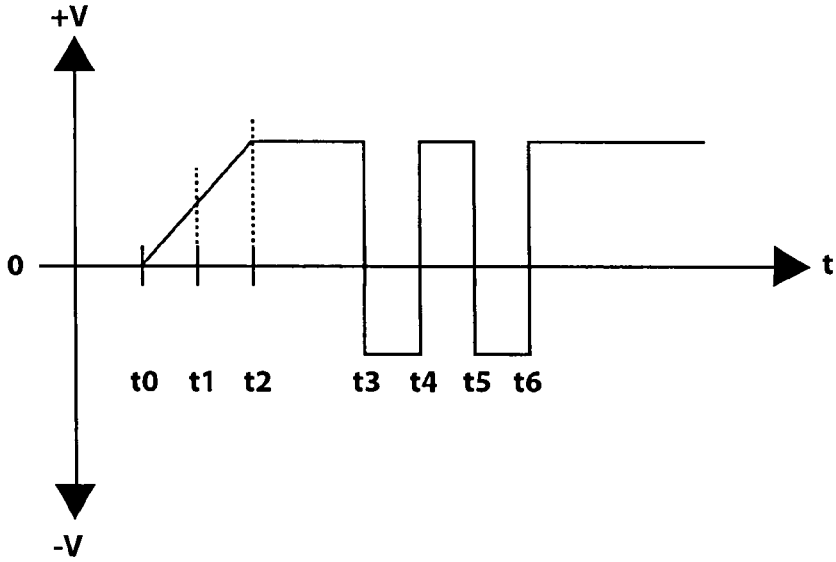
Figure 1: Prior Art

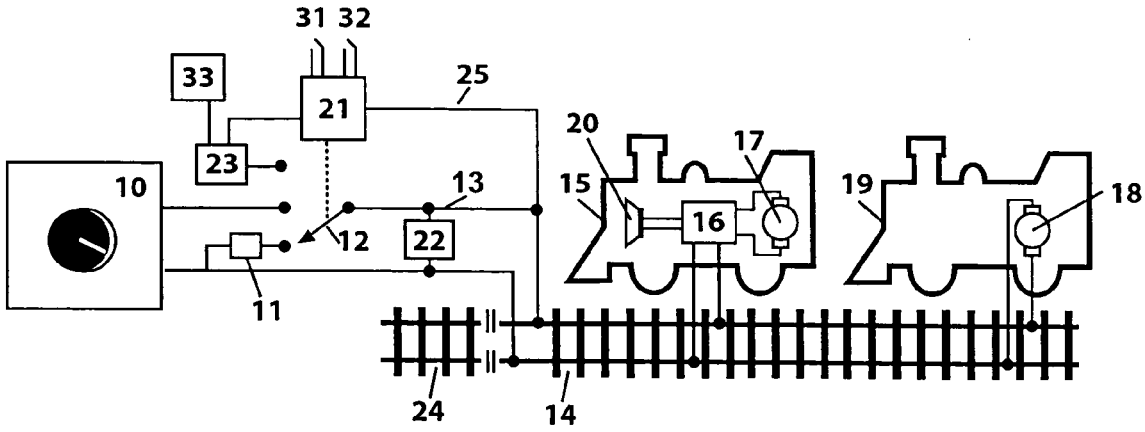
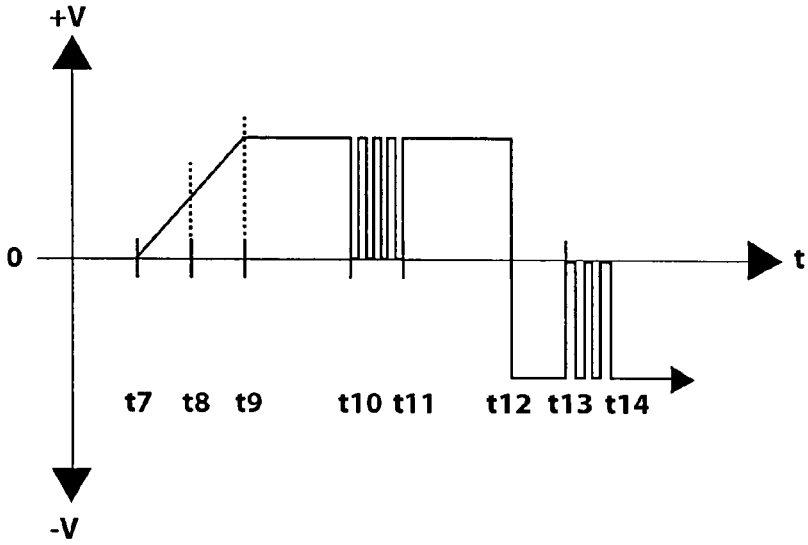
Figure 2: New Art

CONTROL EXPANSION FOR CONVENTIONALLY POWERED MODEL RAILROADS

BACKGROUND OF INVENTION

This invention pertains to the field of control systems for scale model railroad layouts, and specifically to expanding control capabilities, beyond locomotive speed and direction, for conventionally powered model railroad layouts by using mixed power control methods.

The advent of Command Control technologies has led to increased enjoyment and capabilities for model railroaders and their operations of model railroad layouts. All control systems are connected to the layout tracks and are at least capable of controlling the speed and direction of a single locomotive on the train tracks. Conventional AC or DC power control systems adjust locomotive speed simply by the varying amplitude of the track voltage. Direction is controlled by polarity or other encoded track voltage change such as voltage dropouts or higher voltage pulses. Any improvements beyond this basic capability to control other model operating aspects such as lights, sound generators, smoke generators, animation, etc., are considered expanded control function capabilities.

Since the early Carrier Control systems of the 1970's and up to the latest Digital Command Control (DCC) technologies, one key capability of all the technologies is the same. This is the ability to control multiple independently addressed locomotives in the same electrical section of model railroad tracks.

All the technologies that communicate these addressed commands to a particular receiver, or decoder, in the locomotive by electrical conduction via the rails employ some variant of encoded time-varying voltage waveforms, and are termed Command Control systems. In addition, some prior art Command Control systems have been developed that control decoders via a Radio Frequency link or an Infra-Red data link, with energy supplied via the track or batteries, and these variants can be also considered to behave in a similar manner and scope to the systems discussed herein.

As technology and miniaturization have improved, the encoding methods, features and capabilities have been upgraded, but the net effect is still fundamentally that of allowing multiple simultaneous train control capability in at least a single track-section. This is a capability that no earlier conventional AC or DC power control system possessed and is why these older single-control per track conventional control systems have been surpassed by Command Control methods.

The earliest GE "Astrac" system was one of the first analog "frequency modulated" waveform train Carrier Control systems, followed by the control methods employed by Lahti in U.S. Pat. No. 4,341,982. In the early 1980's the Hornby "Zero-One" system, as taught by Palmer in U.S. Pat. No. 4,335,381, provided one of the first examples of a modern Digital Command Control, or DCC, system with digital command encoding methods that are direct precursors of the latest addressable message-based Digital Command Control art. In addition, the Marklin "AC Digital" or Trinary DCC system as an example of a bipolar square-wave digital control signal was also introduced in the mid-1980's, and is taught by Hanschke in U.S. Pat. No. 4,572,996. Bipolar square-wave digital control signals have become widely used because they are easy to create and decode, and the signal also is also the power source to operate the layout.

The freedom to operate multiple receiver, or decoder, equipped locomotives then raises a further question of interchange of and coupling of different technology locomotives on and between layouts equipped with; Carrier Control, Command Control or Digital Command Control and other conventional layouts and locomotives without these new capabilities. These different modes of operations using different control technologies are not inherently compatible. The coupling together of multiple-unit locomotives is termed a "lash-up", or consisting. American prototype railroad practices using diesel locomotives commonly consist two or more locomotives to haul long coal train or other bulk loads, so modelers have requirement to do this on a model railroad to maintain realism.

The problem of interchange of DCC decoder equipped locomotives onto conventional DC power control systems, and also the converse situation of operating DC controlled locomotives on DCC systems, was also addressed by the public domain National Model Railroad Association (NMRA) DCC Standards and RP's, introduced in the early 1990's, that are well known and widely used internationally and that are based on the earlier Marklin "DC Digital" system developed by Lenz Electronik GmbH. This method also uses a bipolar square-wave digital signal that encodes digital command control data by timed changes of track voltage.

In particular, the NMRA DCC technology teaches an automatic, or selectable, Power Source Conversion, or Mode Conversion, option that permits the decoder to detect that it is connected to and then operate on a conventional DC power control system, or other control method, rather than a compatible NMRA DCC encoded control system. This is often referred to as "automatic Analog Mode conversion" allowed by the NMRA [using the optional Power Source Conversion ID codes defined in CV12 of the well known NMRA Recommended Practice RP-9.2.2 and its associated Appendix B] and enabled by the state of the decoder's CV29 bit 2, as defined in the NMRA RP-9.2.2. This was based on an original German patent filed by Lenz and that has since elapsed.

Accordingly, when the decoder (or receiver) detects the tracks being driven by a conventional DC power control system instead of a NMRA DCC signal it changes control strategy and modulates the H-bridge motor drive circuit so as to supply the DC input power to the motor. The speed of the motor is then controlled by the amount of conventional DC voltage supplied, and can also be modified by decoder actions such as simulated momentum. The track polarity of the DC control signal determines the locomotive direction, so the decoder interprets this and drives the motor H-bridge direction accordingly.

The well known NMRA prior art uses the term Power Source or "mode-conversion" to describe the action of a decoder, or other control device, that detects a change of the nature of the track control system it is connected to then allow a change of control action to operate under the influence of the newly detected type of track control system.

Ireland in U.S. Pat. No. 6,513,763 teaches a new method for allowing a digital or Command Control decoder equipped locomotive to operate with correct speed and direction matching when operated on a conventional AC or DC power control system alongside conventional locomotives with no decoders installed. This allows flexibility by allowing the interoperation of a mix of digital and non-digital equipped locomotives on different layout control schemes.

However, while Ireland U.S. Pat. No. 6,513,763 allows for accurate speed and direction control of digital locomotives running on conventional power layouts (i.e. variable analog DC or AC voltage controlled layouts), the digital function outputs used to control lamps, couplers and other items such as sound generators are not fully controllable on these conventional layouts.

Severson et. al. in U.S. Pat. No. 5,896,017 teaches the use of a sequence of DC track polarity reversals and/or High Voltage track pulses to allow limited control of functions on a locomotive to be effected using a conventional DC power control system. For, example when the user briefly and rapidly reverses the track direction control (or polarity) a defined number of times a whistle sound, or a lamp etc., can be actuated. This method is effectively an extension of the Onboard State Generator concept introduced by Severson in U.S. Pat. No. 4,914,431.

While Severson U.S. Pat. No. 5,896,017 teaches a control extension for a conventional DC power control system that requires no new hardware, it has a number of severe drawbacks and constraints that make usage tedious and cumbersome. The use of a DPDT manual switch to create the necessary track polarity reversals for control requires the user to accurately manipulate this DPDT switch with repeatable and recognizable patterns. Thus, if a user fails to properly execute any one of the sequences of multiple switch actuations, then the desired action will not be encoded properly, and this may not be apparent to the user until the expected action does not correctly occur. In addition, there is a likelihood of fatigue or even repetitive stress injury if many actuations are required to realistically operate the model railroad over a period.

For this control method to be effective in expanding the control capabilities of a DC power control system the user now has to remember a complex set of switch actuation sequences, and may have to explain these to a guest user or operator or locomotive "engineer".

If non-decoder equipped conventional DC locomotives are consisted with decoder equipped locomotives controlled by Severson's polarity reversal technique there is a severe problem that these controlling polarity reversals will cause these conventional locomotives to briefly and undesirably change direction. This makes consisting in this manner problematic, and limits the scope and flexibility of this control method. Polarity reversal encodings that are compatible with human hand movements are necessarily slow, and in the range of about 1 encoding polarity reversal per second and so the control rate or bandwidth of this technique is low. This is especially true when contrasted with a Command Control method that typically can provide hundreds or more control encodings per second.

To overcome some of these problems it is possible to place a polarity reversing control unit in series with the DC power control system that uses, for example an interposing DPDT relay driven by control logic to provide accurate, complex and repeatable polarity reversals. This allows the user to actuate one of a number of control switches on this polarity reversing control unit that then encodes a unique control action. An example this automation is a "Sidekick" auxiliary controller produced by QSI Industries of Portland, Oreg. This unit encodes separate key actuations of its user interface to automatically produce the required Severson polarity reversals. This is an improvement over manual switch actuation, but still does not solve the problem of consisting of non-decoder equipped locomotives, or the low control rate.

Severson in U.S. Pat. No. 5,773,939 shows a digital control method where an AC conventional control waveform has its alternating polarity cycles (which they term "lobes") modified in expected polarity to encode a digital command sequence. This has the limitation set by the occurrence rate of the AC cycles, e.g. 120 Hz for US type power 160 supplies, which is too slow for control of fast-changing functions and many locomotives on the layout.

Some systems such a the Hornby Zero-One encode a fast digital coding at fixed times (typically close to power cycle zero-crossings) within a low frequency power signal that is either sinusoidal or even a square wave. These methods also are limited, in that the fast digital encoding cannot occur essentially on-demand or effectively "at random" within the lower frequency power waveform.

Soundtraxx Inc., of Durango Colo., has demonstrated a DCC sound decoder that can automatically convert to operate on a conventional DC power control system and can vary e.g. steam chuffs in response to the DC track voltage and speed. A quick variation in DC control voltage can then be used to trigger e.g. a whistle sound on demand. This is useful to allow some limited DC control of functions (in this case, sound controls), but this is a very limited sub-set of the range of a dozen or more function actuated sounds and other functions available when a DCC command control system is used to control functions.

The goal of all these technologies is to allow multiple locomotives in trains, or consists, to be freely formed with a mixture of different technology locomotives and permit some expansion of control and functions beyond just speed and direction and variation of prime mover sounds like diesel noise or steam chuffs in simple response to track power.

The provision of a control capability that allows expanded control over functions other than speed and direction, without the aforementioned limitations of prior art, is a valuable addition to and improvement over the prior art of model railroad control.

SUMMARY OF INVENTION

Since at least 1997, decoders such as the Digitrax HAG501 have been compatible with multiple bipolar digital command control time encoding techniques, such as NMRA DCC or Marklin Trinary encoding schemes, and are capable of automatically recognizing and transitioning control between different control methods such as digital command control formats and conventional AC or DC power control systems.

However, when transitioning from e.g. an NMRA DCC digital track format to a DC power control system, while speed and direction are controllable in either regime, lamp and other locomotive aspects such sound functions are not explicitly controllable or addressable. These expanded decoder functions may assume a new static state pre-defined in CV13 of NMRA RP-9.2.2. when operating in an alternate control mode. However this lacks the flexibility of functions being under direct control of the user when for example operating on a DC power control system.

The HAG501, and equivalent DH140U, allow the connection of sound generators via an optional Digital Direct Sound (DDS) interface, that conveys sound function control information decoded from the track signals. The lack of expanded function controls for utilizing features such as DDS when a locomotive is operated on a DC power control system is a major limitation on operations and overall flexibility and enjoyment of model railroading.

To expand and provide a new control capability when a locomotive is operated on an AC or DC power control system, it is useful to recognize that prior art implementations of decoder Power Source Conversion (or mode conversion) between different track power and control sources have been considered as executed as a complete change of control methodology between two distinctly different control formats. This is because historically a locomotive employing Power Source conversion techniques can both physically move between track sections that employ wholly different control methods on a single layout, as well as be used on separate layouts with different control methods, e.g. a DC power control area and a DCC control area. They have not been intended to work in an environment that is intentionally a simultaneous mixture of control methods.

The prior art does not recognize or teach, for example that it may be useful to perform a new type of "combined" Power Source or Mode Conversion based on a signal that is not just DCC control or conventional control, but is a simultaneous combination of both functional control signals and that is intended to be interpreted in combination in a decoder. For this invention this intentional combination of control modes and signals is termed mixed-mode operation.

A simple example of this new control art would be a track section that uses conventional varying amplitude DC track voltage to control speed and DC polarity to control direction which now has brief encoded bursts of DCC or other bipolar square-wave digital encoding embedded freely within it. The benefit of this novel combination is that conventional DC controlled locomotives will be controllable in speed and direction alongside the digital decoder equipped locomotives and that expanded function control is now possible with any decoders that employ this invention to decode simultaneous bipolar square-wave command methods. The interpretation of simultaneous conventional commands by the digital decoder is needed, so that the decoder equipped locomotive can understand the operation of a conventional locomotive that it may be optionally consisted or linked to and hence operate in speed and direction harmony with non-decoder equipped locomotive.

To make this mixed-mode control capability useful and functional, it is important that control information is interpreted in a non-conflicting and consistent manner between the multiple command modes and commands intended to be seen simultaneously by a decoder device. With this example, since the DC conventional control power is best utilized to control speed and direction of any locomotive operating on this new mixed signal, the decoding of the embedded DCC digital commands could then selectively ignore digital speed and/or direction commands seen. It is useful to have predefined rules of decoding behavior and selection methods to configure under which circumstances control modes have priority.

In this particular DCC/DC example it is in fact unnecessary for DCC digital speed and/or direction commands to be sent at all, which can be used to save DCC control bandwidth or number of DCC code bursts inserted into (and maybe perturbing) the DC track control voltage. A bipolar square-wave digital signal may be inserted often enough and be of a predetermined amplitude to ensure that at even low DC power settings, sufficient energy is communicated to keep the decoders "alive" (operative), albeit with reduced power resources. A bipolar square-wave digital signal is designed to be of sufficient current and/or energy capacity to inherently provide operating power along with control information. Since decoders can remain active and have may have internal non-volatile data storage for speed and state information, any commands communicated may be limited to being sent when there is a state change required, and any other repetitions would be added as needed for redundancy, reliability and recovery from power disturbances such as derailments etc.

In addition, the optional presence of digital speed and/or direction information while conventional power is chosen to be the priority for speed and/or direction control, may be used to invoke a modified decoder control algorithm. An example of this would be using a bipolar square-wave digital speed command of zero speed (stopped) either at the decoder's digital address, a broadcast address or any other predefined address, to temporarily override the conventional speed control and force braking or the locomotive, or to "park" it even while applied conventional DC or AC power allows lights and sounds to remain operating. Clearly this control variation is useful, but would not be selected in the case of decoder-equipped locomotives being consisted to any conventional locomotives.

Other useful operating combinations of two or more intentionally mixed command modes may be easily imagined using this broad methodology and be within the scope of this invention.

A priority for command interpretation in decoding devices must be defined to avoid unpredictable interpretation of these intentionally mixed control signals employed by this invention. To implement this invention prior art digital decoders are re-configured to allow proper and sensible control operation when more than one control signal is identified as being present, and that these may be juxtaposed or combined in any manner that allows expanded control capability during conventional power operation. In particular, the operation when employing conventional speed control must permit bipolar square-wave digital commands to be decoded to allow, for example expanded function control, without disturbing the mode conversion algorithm that allows the conventional power control system to properly and smoothly control the decoder-equipped locomotive's speed and direction.

This does not preclude the possibility that commands conveyed by a bipolar square-wave digital command could selectively modify the interpretation or priority of the simultaneous conventional control voltage.

For example, an NMRA DCC expanded digital function could also be configured to perform a brake or "park" function and stop a locomotive even though a DC control voltage is not zero or even changed, i.e. in this case conventional DC speed control priority is temporarily ceded to and overridden by a predetermined digital command. It is also possible for the DC direction interpretation to be modified this way.

The mixed conventional and digital control signal employed by this invention can be created in many ways, such as by; a bipolar square-wave digital track control unit modified to add a conventional control capability, a modified conventional AC or DC power control system with bipolar square-wave digital control added, by adding an after-market bipolar square-wave digital controller to the output of an existing conventional power control system or by adding an after-market conventional controller to the output of an existing bipolar square-wave digital control unit.

This invention can be employed in conjunction with the art taught in Ireland U.S. Pat. No. 6,513,763 to provide a comprehensive control capability for a locomotive running on a track section utilizing a DC power control system, alongside unmodified conventional locomotives.

Note that this invention is best employed for a conventional DC power control system signal mixed with bipolar square-wave digital control signals such as NMRA DCC and/or Marklin Trinary, but may be also employed in conjunction with a conventional AC power control system.

Prior art decoders that allow Power Source or mode conversion have to deal briefly with an unavoidable and likely admixture of paralleled track control signals when rolling stock transit and short between track sections with different control power methods. In this case, extra time and state filtering and logic is in fact specifically required to deal with these transiently mixed control methods, so that for example a DCC locomotive going into a DC track section commanding a direction reverse does not "bounce back" continuously to the DCC track section or vice-versa.

So, with prior art, the transient mixture of track power control methods is adverse and has to be guarded against, not employed for beneficial use. In the example of DCC track section abutting a DC track section it is often prudent to use a lamp or other impedance-control device in one of the power signal connections to allow one control signal to temporarily override the other completely. Otherwise, the actual track signal or voltages may become indeterminate until the bridging actions ceases, or even unintended damage may occur to the control units.

The application of selectable steady DC power onto a track section abutting a DCC section, allows the prior art concept of a "DC braking section" when a decoder has the NMRA defined CV29 bit 2 configured to not allow automated Analog (or alternate) Power Source Conversion. Here the locomotive with any digital address will come to a stop under DC power and CV13 can be used to preset active functions. While in this "DC brake state", the prior art does not teach modifying this DC signal to provide expanded control possibilities. Braking is ended when this DC track section is switched back to the DCC signal, which frees the locomotive to respond to the DCC speed commands subsequently addressed to that decoder. Here the control actions of decoders designed to allow proper operation on a "DC braking section" or allow Power Source Conversion to DC or AC conventional power control are clearly different to the method of this invention.

In 1998 the NMRA documented in Technical Information bulletin TI-9.2.1 a method for selectively modifying a DCC control signal at specific time periods so as to allow a modified NMRA DCC signal to perform a "speed restriction override" in front of a railroad signal. This action is similar to, but more powerful than the DC braking section method. This is an example of combining two command mechanisms but is unlike this invention, in that the deleted DCC pulses do not form a conventional DC or AC control signal that can also control a conventional locomotive. In addition, no Power Source Conversion occurs in the power source for the motor, since the signal does not change its fundamental nature and is still clearly a NMRA DCC waveform.

In the 1990's Umelec from Switzerland introduced a method of selectively time modifying the voltage symmetry of the opposite polarity excursions of a bipolar square-wave digital control waveform to provide an extra control signal, in addition to digital commands sent to a decoder. This method also does not create a conventional DC or AC control signal, cannot control a conventional locomotive not equipped with a decoder and does not force a Power Source Conversion.

The CVP Products "Rail Command" system introduced in the 1990's employs a control signal mixed on a 12V DC power signal, but the DC power signal is constant and not used to independently control any DC locomotive at the same time as a decoder equipped locomotive in the same track section.

The Mike's Train House "Digital Control System" introduced in 2002 employs a wideband spread-spectrum digital RF control signal impressed on an AC power signal, and is also designed to control an older conventional Lionel-type AC locomotive with no decoder. This system does not employ a bipolar square wave for the digital control signal. In addition the MTH digital RF control signal is inoperative by itself and cannot power, nor is it intended to keep alive a decoder or control a locomotive in the absence of some additional other conventional control power. The Wolf et. al. U.S. Pat. No. 6,457,681 embodied in the MTH products does not teach that conventional power control mixed on the track are intended to also be simultaneously directed to and be decoded in combination by their spread-spectrum RF digital decoder, and that this may expand control possibilities.

The track polarity reversal sequences employed by the Severson U.S. Pat. No. 5,896,017 prior art for extra control encoding is distinctly unlike digital command control signals in that it does not encode high capacity and complex address-prefixed formats like NMRA DCC or Marklin Trinary, and is also of very much lower bandwidth due to reasons of compatibility with essentially manual methods used for polarity reversal generation. In addition, Severson has to employ the assistance of the Onboard State Generator concept to expand control capabilities from a meager set of track signals, whereas digital command control typically conveys a complete discrete command in its decodable entirety, with no ambiguity, or requirement to assume prior control sequences, states or "reset" states. Note that NMRA DCC commands or "packets" are encoded in typically very short 3 to 5 millisecond bursts, which means any DC voltage disturbances can be significantly smaller than reversing commands of the low control rate art of Severson.

Thus, these examples of known prior art are clearly distinguished from and have less capability than this invention.

This invention is not intended to be solely limited to NMRA DCC encoding scheme decoders, and may be employed in any type of decoder or receiver used for model layout control purposes, by those skilled in the art of electronic circuit and control software design using the methods presented herein. A decoder device has the responsibility of recognizing the type of command encoding signals that are mixed or juxtaposed on the track or layout, and then correctly infer and perform an optimal control strategy as taught herein for expanded control capability. Note that even though most benefit may be gained while operating decoder equipped locomotives on a layout controlled predominantly by DC power control systems, this invention may also be employed when other types of power control system signals are introduced onto a predominantly square-wave DCC controlled layout or track section.

ATTACHED DRAWINGS

5 Sheets

FIG. 1 details the typical track connection arrangement and time/track-voltage waveforms of the elements of the Severson prior art.

FIG. 2 details the typical connection arrangement of the elements and mixed-mode time/track-voltage waveforms of the preferred embodiment.

FIG. 3 details a more complex mixed-mode combination of conventional and digital commands in a time/track-voltage waveform graph.

Figure 4:
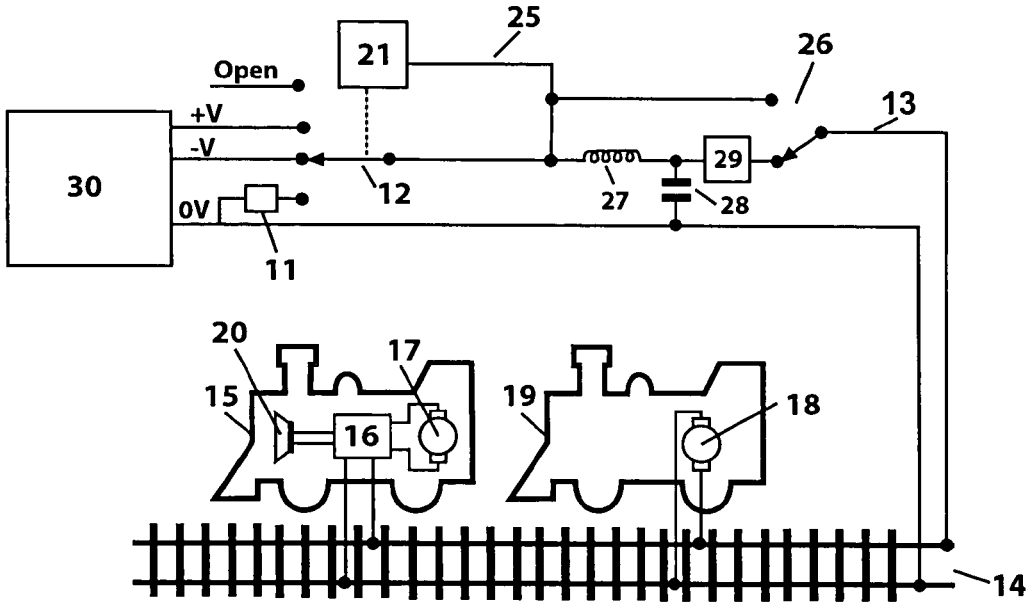
Figure 5:
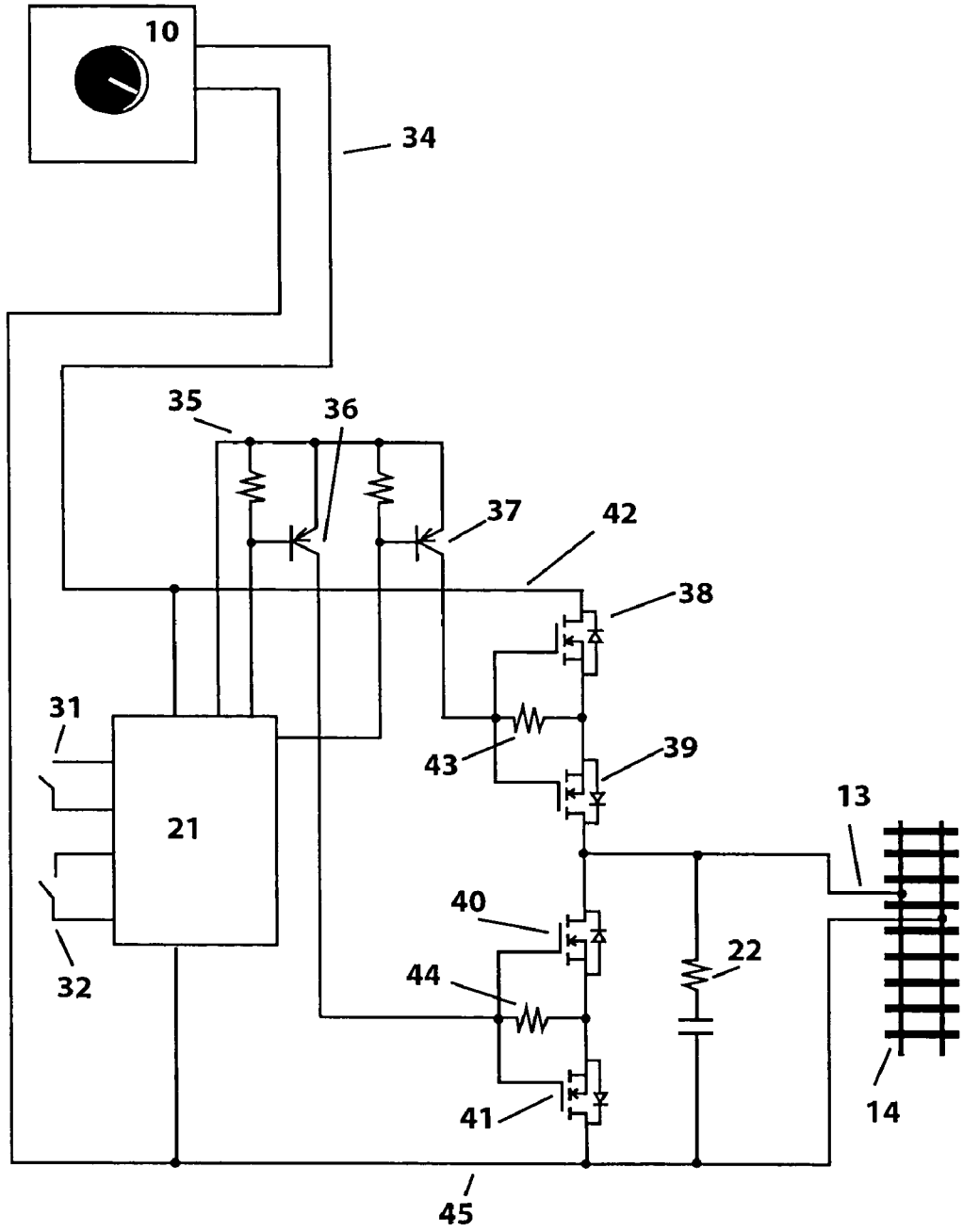
Figure 6:
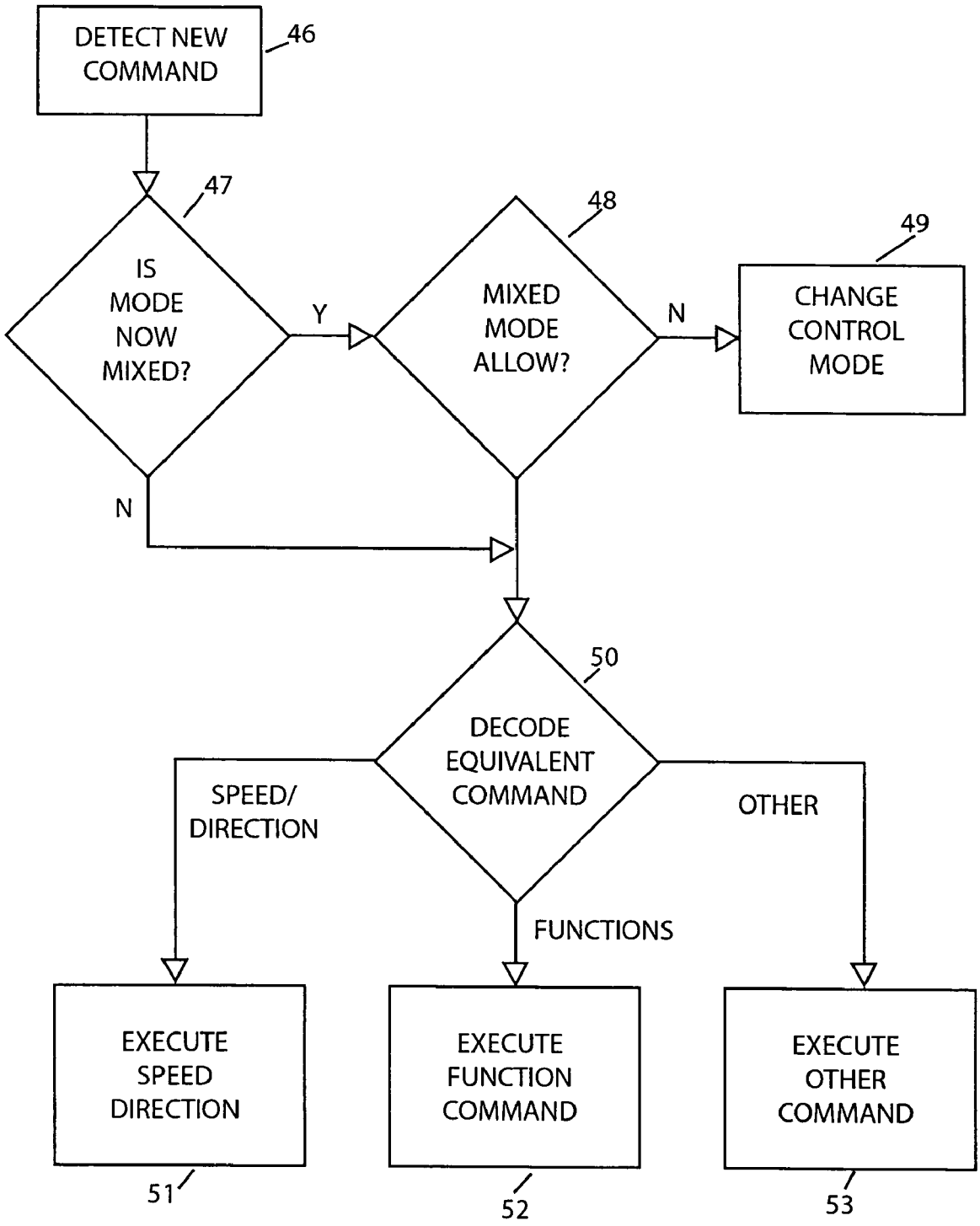

FIG. 4 details a mixed-mode embodiment with an expanded range of control voltage sources FIG. 5 details the schematic of a control switch and logic arrangement of the preferred embodiment FIG. 6 details a mixed-mode control algorithm

DETAILED DESCRIPTION OF INVENTION

FIG. 1 depicts many key elements of the general electrical connection arrangement of the prior art of Severson U.S. Pat. No. 5,896,017, and includes a graph of typical time varying track operating voltages conducted by output connection 3 to the model railroad track 4. Aspects of this prior art arrangement are useful for understanding the new art. Item 1 represents a conventional DC power control system that can only control locomotive speed and direction that has its output voltage connected to a Double Pole Double Throw polarity reversing DPDT switch 2 that ultimately connects via track connection 3 to track 4. A locomotive 5 picks up the track voltage via wheel pickups and communicates this voltage to a decoder 6, which then controls the connected DC motor 7. The operating energy for DC power control systems may come from a wall power transformer or battery etc. This operation of a DC controlled locomotive on a model railroad track is well known.

Included in FIG. 1 is a time/track-voltage graph. At a time t0 the user changes the DC power control system output from zero volts and starts to increase this voltage that is then ultimately communicated to the track 4 and locomotive(s) 5 & 9. At time t1 the track voltage is now sufficient for decoder 6 to operate, and the DC motor 7 will then be configured by the decoder to run, with direction commanded by the track polarity measured by decoder 6. Time t2 represents the locomotive reaching an operating speed the user commands.

Between time t3 and t4 the polarity reversing DPDT switch 2 is operated to create a track voltage polarity reversal as taught by Severson. This polarity reversal is made after the DC power control system and is not meant to reverse the locomotive direction but is an encoded state change that is interpreted by the Severson art in conjunction with a second polarity reversal at times t5 to t6 to command a new action or function that the DC power control system cannot perform itself.

A second DC motor 8, in a second locomotive 9, that is connected to the same track voltage without an interposing decoder will see the polarity reversals at times t3 to t4 and t5 to t6 and will then undergo speed reduction, and possibly direction changes. This is because reversal time periods are manually generated by a user operating DPDT switch 2, and these will generally be a substantial fraction of a second, e.g. about 500 milliseconds. DC motor 8 has a typical characteristic or mechanical response time of 20 to 50 milliseconds, depending on; motor design, load and gearing attachments in the locomotive. Since the DC motor can respond much faster than the reversal event durations, a speed change is very likely.

If DC motor 8 is in a separate locomotive 9 that is consisted to locomotive 5, then clearly the two locomotives will have conflicting speeds and may fight or jerk and tend to destroy the illusion of being consisted.

Other problems with this Severson art include the fact that there are voltage losses within decoder 6 that result in DC motor 7 having a lower operating voltage than the track voltage seen by DC motor 8. Employing the Ireland art of, U.S. Pat. No. 6,513,763, can solve this problem when operating on conventional power by selectively connecting DC motor 7 directly to the wheel pickups when conventional DC power is measured or detected.

In addition, commercial decoders using the Severson U.S. Pat. No. 5,896,017 art are configured at time t1, as stated in their user manuals, to begin operating above 5 to 7 volts on the track, which is a significant operating difference relative to a non-decoder equipped locomotive 9, which may start moving with as little has ½ volt of DC track voltage. In fact the disparity in start and operating voltages will cause one of the locomotives to assume most of the load and can lead to an overload situation.

New Art Arrangement:

FIG. 2 shows an example of a general connection and the time-voltage waveforms for the new art of this invention. A conventional DC power control system, 10, that can only control locomotive speed and direction, is connected by power control switch, 12, via track connection 13 to tracks, 14. Track pickups in locomotive, 15, convey track power to decoder, 16, which then controls DC motor, 17, as well as an expanded control function example of sound, represented by speaker 20.

Power control switch, 12, can most simply be implemented as a Single Pole Single Throw (SPST) switch that interrupts or modulates the DC power to generate a time-voltage encoded digital command which now acts as a mixed control signal in conjunction with the conventional track control power.

This arrangement is configured so that the DC power control system, 10, defines all the track voltage maxima. This FIG. 2 configuration is an example of an embodiment that is designed to be added to the output of an existing conventional DC power control system, 10, and does not need any extra power supplies and does not substantially change the prior DC track control voltages to provide expanded function control.

An additional track section, 24, is shown to indicate the locomotives can move to a different track area, which may have a very different power and control method.

The time/track-voltage graph in FIG. 2 shows the DC power adjusted by the user changing from zero volts at time t7 to a decoder threshold voltage at time t8, which is sufficient for decoder 16 to operate. A further voltage increase until t9 then establishes the desired locomotive speed. Between time t10 to time t11 the Power control switch, 12, is rapidly controlled from On to Off states by digital control element 21 to create a predetermined time-voltage waveform on track 14 that digitally encodes a command. Control element 21 includes a means by which users can select and actuate predefined functions, such as e.g. binary or on/off function 0 switch, 31, for headlight control and function 2 switch, 32, to blow a horn or whistle sound effect etc. It is also possible that these predefined function switches can be configured as variable or proportional intensity controls to e.g. control a whistle pitch or sound volume etc.

An important improvement in the new art is to design decoder 16 to begin operating when the track voltage is above about e.g. 2.0 volts, which is significantly better than prior art. This may be achieved by employing a well-known SEPIC topology power converter inside decoder 16 that can produce a stable internal operating voltage when the track voltage is either higher or lower than this stable internal operating voltage. This is different to a boost/buck type power converter.

The complete time-voltage encoded digital command in period e.g. t10 to t11 is typically 3 to 5 milliseconds in duration, using common and practical digital encoding methods, and so is more than a hundred times faster than the sequences t3 to t6 etc. used to generate an expanded control command by the Severson prior art of FIG. 1. The number and relative size of the voltage pulses depicted in FIG. 2 etc., simply stand in for real digital encoding waveform pulses that are more complex, numerous and relatively faster than can be shown here. An example of a suitable waveform timing and encoding method for the basis of a burst from t10 to t11 (and t13 to t14) can be found in the well-known NMRA DCC Standards Section of the www.nmra.org website. Most modern digital encoding methods employ time encoding to convey data and are somewhat insensitive to the absolute voltage levels on the track.

When a SPST implementation of power control switch, 12, is in the Off state the track connection 13 is then open circuit and the voltage on track 14 will decay to zero volts, due to power draw on these tracks. Now the On and Off state periods impressed on the track by 12, can be detected and decoded by decoder 16. At time t12 the user commands a direction change with the conventional DC power control system, 10, using a polarity reversal of the DC output power, and locomotive 15 and 19 then both respond with a direction change.

For completeness another distinct and complete digital command is shown encoded in the voltage sequence between time t13 and t14 when DC operation is in the opposite direction. Note that this digital encoding follows a bipolar square-wave digital method for timing and encoding, but in fact the track voltage is unipolar and not bipolar in the digital periods in this example, in that it is not switched to a reversed track polarity at the digital coding rate, as for example; NMRA DCC, Motorola Trinary or Fleischmann FMZ etc. are.

Decoder 16 is designed to allow for a variation of allowed digital encoding voltage range such as unipolar, bipolar or other ranges as needed and still be able to recover the encoded digital information correctly from the timing information. Not requiring a polarity reversal to encode a digital command allows the mixed-mode power modulation element, such as power control switch 12, to be a simpler switch configuration, because it does not have to operate in a DPDT reversing mode for any particular incoming DC control voltage polarity.

If a conventionally controlled locomotive without a decoder, 19, is added to the tracks, 14, then its DC motor 18 will see the same track voltage conducted by connection 13 as locomotive 15. In this case, the encoding On/Off state time periods of power control switch, 12, are chosen to be of a shorter duration compared to the mechanical time constant of locomotives 15 and 19, so the series of switch operations between t10 and t11 encoding a digital command causes very little disturbance to the average overall track voltage and hence locomotive speeds between times t9 and t12. This means the triggering of a digital command at time t10 by digital control element 21 in response to a user input from switches 31, 32 or similar will cause only a small disturbance to the speed of both locomotives on the tracks.

The algorithm employed by decoder 16 to decide whether to mode convert to control DC motor 17 from DC track voltage conventionally commanded speed, or from a digital commanded speed is critical to the correct operation of this invention. Expanded function commands decoded from the digital commands, such as those to control sounds issued from speaker, 20, can be allowed to operate in either power source or mode, since there is no likelihood of conflicting command effects i.e. digital expanded function commands can be decoded in all modes. This is clearly not true for basic speed and direction control.

Clearly speed and direction control must be carefully designed and configured for best operation between conventional speed and direction commands and any equivalent control functions of embedded digital commands.

Prior art automatic power source or mode conversion for e.g. NMRA DCC decoders is inherently sequential and cannot operate reliably upon encountering a first single digital command of any type when in DC power control mode. This is because it is likely that transient digital commands can be encountered when locomotive wheels unpredictably bridge different types of powered tracks, such as DC to DCC tracks. Correctly sequenced and detected mode conversion is very important to ensure locomotives do not surge in speed or change direction upon executing a Power Source or mode conversion, which would tend to destroy the illusion of realistic operation.

To ensure a decisive and smooth mode conversion, decoders need to make sequential mode conversion decisions based on the history of commands encountered and then defer a mode conversion decision until the correct operating power mode is stable and detected for a sensible duration.

This filtering algorithm is also needed when converting from DCC to DC operation when digital packets are not detected as expected after a time, and DC power is encountered instead. When a mode conversion decision is made upon stable track commands, the direction and speed between the two power modes must be considered to avoid direction changes across the track power transitions. Several control choices can be made to avoid direction oscillations due to conflicting locomotive directions at the point after mode conversions occur. The simplest is to allow "bounce" or direction reversal in one mode conversion only, and to stop the locomotive in the opposite mode conversion case.

Prior art power source or mode conversion algorithms (or control logic) are not suitable for this invention, because for example, time periods t9 to t10 (DC control encountered) and then t10 to t11 (digital control encountered) would ordinarily imply a sequential mode change from DC to DCC or digital control, where this is clearly now not desired. With the prior art there is no expectation of valid expanded function commands being embedded consistently within conventional DC track control power. Even if these are seen, since the mode should not change instantly due to conversion filter logic, these function commands would be inappropriate and hence should be ignored.

If a prior art decoder were to immediately mode convert to DCC upon seeing e.g. one or more DCC function commands embedded within a running DC track voltage, then it would face a problem in that it would be expected to brake to a stop if analog mode conversion capability were not enabled. Thus prior art sequential mode conversion algorithms are distinctly different from those employed by this invention.

If prior art mode conversion is made for example, on the second or later of a multiple burst of repeated or closely spaced digital commands there is still a problem when a constant period of DC conventional power is still present, since a mode conversion back to DC mode will be made under some condition and timing variation. A constant changing of modes due to mixed digital and conventional signals on a track would be a problem since the motor speed between the two modes is not generally the same. Note that the NMRA defined CV13 allows the headlight function (function 0) to be selected active when on DC power or some alternate Power Source conversion. If the decoder then uses the "directional lighting" method, then the locomotive forward and reverse headlights will change state based on direction. In the DC mode conversion case this would not be considered an expanded function capability even though the lights can change in response to a DC direction command, since the underlying headlight function control (function 0) cannot have its state changed while in DC mode.

A decoder 16 that is designed to operate correctly with concurrent mixed control signals now has many different choices of new control and mode conversion algorithms possible that allow correct operation with prior art type mode conversion scenarios, while still allowing new digital control expansion in conventional power modes.

Mixed Power Generation and Decoding Rules:

When in DC power mode, if no digital speed or direction commands are seen on the track, because the digital control element 21 is configured to not encode these combinations, then the decoder 16 can correctly make mode conversion decisions based on the subsequent occurrence of any digital speed and direction commands. All other digital commands that do not affect speed and direction can be executed and will now not be allowed to invoke a mode conversion change. A decoder can automatically detect the absence of speed and direction commands when other digital commands are mixed with conventional power and be able to infer this condition. This is perhaps the simplest mode for the digital control element 21 and decoder 16 to deal with, and is a reasonable default.

Within the decoder it is useful to add user settable configuration switches in hardware or in non-volatile programmable memory that will pre-select; the exact algorithms used for mixed-mode operations, and any optional control characteristics such as; an enable control bit for brake action being allowed, etc. This allows a default setting that will work correctly irrespective of the digital control element 21 configuration, which itself can also have configuration switches to preselect its behavior.

Both digital control element 21 and decoder 16 have separate useful operational states that are compatible with mixed-mode operations when they are not actively employing the technique. For example, digital control element 21 in combination with power control switch, 12, convey the DC power to the track in anticipation of the possibility that digital commands may be generated by a user, and may employ other control methods such as track short circuit detection and recovery, using an additional current sensing link 25, etc. Decoder 16 may employ an improved internal power supply and voltage detection logic that allows reliable detection of track voltage changes at low track voltages and an environment that does not have a bipolar voltage swings during the digital encoding period.

A decoder 16 may allow proper mode conversion between a digital track section and a conventional track section even if mixed-mode control operations never occur. The additional combination of mixed-mode control operations provides the extra function expansion capability but the individual components must separately employ these methods to be fully operative. For decoders without this new mixed-mode command capability, it is unlikely that they will properly be able to determine what mode conversion to employ if they are placed in one of the variations this mixed control environment.

Digital speed and direction and expanded function control commands can be directed to decoder 16, any different address decoder, or broadcast to all decoder addresses active on the track. If a predetermined digital address is chosen to be a Broadcast address, then digital commands to the Broadcast address will control the expanded functions on all decoders and have the benefit that the exact address of decoder 16 need not be known while operating in mixed-mode control on track 14.

This allows variations of the new mode conversion algorithm where, for example an embedded digital Broadcast command of zero speed can be used to brake and/or stop any locomotive while in DC conversion mode on a DC powered track. This behavior can be modified if a command is directed specifically to the address of decoder 16. In this example of a braked locomotive, a DC speed command change of higher DC track voltage can now be further employed to increase the motor sound pitch and amplitude to simulate the motor being revved up etc, even though the decoder keeps the motor in braking. This is an example of a new compound command capability that results from the interaction of multiple commands in a mixed-mode control scheme.

Note that commands are sent only when a state change is needed in decoder 16, so normally digital commands need not be repeated, but occur at times when invoked by the user. Other digital command combinations may alternatively be used to also modify the DC commanded speed and direction when on DC power. For example one of the function controls, e.g. numeric control Function 7 can signify that braking is to be in effect, by overriding the DC commanded speed and decaying it to zero speed at a predetermined rate. Other digital command combinations or sequences can be employed to provide any other new form of modified operations when on a track with mixed-mode control.

If digital control element 21 allows speed and direction commands mixed in with DC power, then more complex decisions will necessary to provide correct and predictable mode conversion operations. In this case speed and direction will not be executed until a predetermined decision threshold is crossed and a mode conversion to digital control is made. A time based criteria for DC power presence, in conjunction with a weighted preponderance of time with DC power on the track, can be used to enable mode conversion to DC power. For example, decoder 16 may determine that more than 50% of the elapsed time in a predefined detection sample period has been DC track voltage and so this is a threshold to change state to DC power controlled mixed-mode operation.

Then, the digital speed and direction commands will be ignored until the DC power state drops below a decision threshold to allow conversion back to digital mode, e.g. less than 40% of the time is DC power. The actual decision thresholds can be selected based on a number of criteria, but are best chosen so that the fastest digital command insertion rate in DC mode does not result in an incorrect mode conversion choice.

Using this new mixed-mode control strategy and properly deciding when Power Source conversion or Mode conversion may occur, if decoder 16 is now configured so as not to change from DC control to digital control strategy of the motor during digital encoding periods t10 to t11 and t13 to 14, then the locomotives 15 and 19 will behave in a compatible way, just differing by the voltage offset due to decoder 16 losses when mode converted.

If decoder 16 additionally employs the Ireland U.S. Pat. No. 6,513,763 art, to connect DC motor 17 directly to the tracks in the control period, t8 to t14 then effectively DC motor 17 operates with an identical response to DC motor 18 during this time. This is true when all DC motors see the same exact voltages.

Inductance Management:

DC motor 18 connected directly across the tracks has characteristic inductance, and when the motor load current is interrupted by an SPST power control switch, 12, entering the Off state, the track voltage will be strongly affected by this inductance. This is in such manner to cause a transient reverse voltage spike and a possible sinusoidal ringing waveform that distorts the intended digital encoding and may make it unrecoverable to any decoder. To control this a snubbing network 22, comprised of a collection of reactive and real impedances, may be added in parallel to the track feed 13. The impedances comprising snubbing network 22 are chosen by standard engineering procedures to limit track inductance from distorting the track waveform unduly. In addition to, or as an alternate to, snubbing network 22, the SPST implementation of power control switch, 12, may be changed to an alternate SPDT arrangement so as to switch track feed 13 to termination element 11 when the power control switch is in the Off state. The impedance of termination element 11 can be chosen in a similar method to that for selecting snubbing network 22, or may in fact simply be a low impedance short-circuit, such that the track voltage across 13 is actively clamped at some threshold low voltage value when the expected inductive transient occurs.

Power Switch Device:

The implementation of a SPST or SPDT power control switch, 12, depends on the actual digital encoding rate chosen and the motor mechanical time constants of the locomotives that constrain this choice. A very fast relay is a possible choice, but for practical designs the switch element is best implemented with faster electronic power switching devices, e.g. bipolar or MOSFET transistors, Triacs or GTO SCRs or IGBT transistors, etc. Those skilled in the art of circuit design may configure a combination of these devices in a manner to provide the required switching characteristics needed to create the mixed-mode control waveform taught herein.

FIG. 2 shows the track waveform to be constrained between the present output voltage of conventional DC power control system, 10, in the On state and decreasing to about zero volts when 12 is in the Off state. This is due to the fact that power control switch, 12, only switches the available input power from 10 and does not have another auxiliary power source. Digital control element 21 may also be connected directly to the output of conventional DC power control system, 10, and will be designed to operate by at least the minimum track voltage at time t8, when digital control of the decoder is expected to be possible.

Alternate Power Switch Embodiments:

An alternative arrangement is for power control switch, 12, and digital control element 21 to be configured with an auxiliary digital signal generator 23 that can be selected to provide an alternate digital track control signal (e.g. NMRA DCC) with track voltages different from those provided by the separate DC power control system, 10. Auxiliary digital signal generator 23 includes a separate power source 33 that enables the generation of the alternate digital track control signal even when DC power control system, 10, has zero output voltage. The alternate digital track control signal can also be a signal of sufficient voltage to impart significant extra energy to decoder with onboard energy storage capability.

Decoder 16 may include an additional power supply and initialization capability that allows it to be powered up rapidly at the beginning of a single digital command and to be able to detect, capture and decode this command and may also store this in persistent or non-volatile memory. This ensures that decoder 16 can detect and remember a new command state even when stationary with no conventional power available, and can then execute these new command states when conventional power is again applied to allow motor, sound or other functions to operate.

To ensure decoder 16 has sufficient initialization time upon encountering an isolated digital packet on otherwise unpowered track it is useful to time extend the existing defined beginning preamble to the digital encoding method. In addition, if an identification, alarm or data feedback method such as taught in Ireland U.S. Pat. No. 6,220,552 is desired, an extended post-amble of extra redundant encoding cycles can be added at the end of a digital command to allow detection in response to an addressed digital command. If the address of a decoder entering mixed-mode control is unknown, then it can be automatically read by the addition of a specific digital command at a predefined address that will induce the decoder to output its active digital address. A broadcast address can be used for this purpose and is convenient since it allows control of all decoders without a-priori knowledge of the address.

The time/track-voltage graph in FIG. 3 shows the DC power adjusted by the user changing from zero volts at time t15 to a decoder threshold voltage at time t16, which is sufficient for decoder 16 to operate. A further voltage increase until t17 then establishes the desired locomotive speed. At times t18 until t19 power control switch 12 selects a digital waveform encoded by the combination of 21 and 23, that has a different voltage maxima from the DC control voltage. After time t19 the track voltage reverts to the DC control voltage and at t20 the user decreases the DC voltage to slow and stop the locomotives by time t22. At time t21 the track voltage is below the decoder threshold voltage and the decoder will stop operating. The alternate voltage codings selected during periods t18 to t19 and t23 to t24 in FIG. 3 are shown as bipolar signals, and in practice it is also possible to have these voltage codings not reverse polarity but encode digital data in the same timing information of changes from zero to a peak voltage value. This is a beneficial improvement to the decoder capability and it allows a digital command encoding that can optionally be unipolar, which can simplify some embodiments of power control switch 12. Here a decoder can automatically detect an encoded digital command when the voltage is either bipolar or unipolar but using the same digital timing for command encoding.

At time t23 the DC track voltage is zero, commanding a stop, and a new digital command is now encoded until time t24. In the period t23 to t24 the decoder will become operative and if designed as discussed earlier to respond to single digital commands will remember in non-volatile (or volatile memory) a new digital command, for example to turn on a sound effect in speaker, 20, when power is sufficient. After time t24 the track voltage is zero again and the decoder can assume during its brief power holdover capability that no new command should be executed immediately, since power has been removed.

At time t25 the DC power is adjusted by the user from zero volts to a decoder threshold voltage at time t26, which is sufficient for decoder 16 to operate and begin executing of any commands stored from a previous power cycle. A further voltage increase until t27 then establishes the desired locomotive speed in the reverse direction.

With modern electronics components a high level of integration is possible such that an implementational distinction between the functional elements; power control switch 12, digital control element 21 and auxiliary digital signal generator 23 is hard to make. What is important is that a combination of components creates the needed mixed control mode waveforms described here. For example, it is feasible to make the active devices of power-control switch 12 also create the digital signal provided by auxiliary digital signal generator 23, acting under the timing and control guidance of digital control element 21.

FIG. 2 shows the DC power control system, 10, as a separate device, with the digital command functions being added after this voltage is generated. It is also possible to provide this DC control system output voltage by using a modified power control switch 12, that configured to alternatively generate a variable and smooth DC voltage created by Pulse Width Modulation (PWM) followed by an output filter that is switched out during digital waveform encoding. Discerning users prefer that any DC control voltages be filtered DC to minimize noise and heat buildup in their locomotives.

Integrated Mixed-Mode Embodiment:

FIG. 4 shows an alternate embodiment of this invention that can efficiently create a mixed-mode control waveform of square-wave digital encoding interspersed with a variable DC voltage without the need for the DC power control system, 10. Digital control element 21 is configured to make power control switch 12, alternately select from multiple voltage source choices presented by separate power source 30:

1) To generate a digital waveform, power control switch 12 is switched between the two voltage source choices shown and +V and −V, which will produce a reversing and alternate positive and negative output voltage to track connection 13. The output filter switch 26 is set opposite to the setting shown in FIG. 4 to bypass any output filtering action so the resulting square wave and all its' harmonic content are preserved. The switching of power control switch 12 is timed to create a digital encoding such as Marklin Trinary or NMRA DCC, as either bipolar or unipolar digital signals. A selection of 0V (zero volts) instead of a reversed voltage to generate a unipolar digital signal instead of a bipolar digital signal is also possible.

2) To generate a positive smooth DC track voltage between digital encoding bursts, filter switch 26 is in the position shown in FIG. 4, and power control switch 12 is rapidly switched between the two voltage source choices shown as +V for On and 0V for Off, with an On time at the +V position being the PWM controlled duty cycle that is proportional to the DC voltage desired. The filter elements, inductor 27, capacitor 28 and impedance 29 act to filter the high frequency PWM square wave, and the voltage seen at track connection 13 is now a filtered DC voltage. The PWM pulse repetition rate is chosen so as to allow sufficient DC filtering and voltage ripple with small component values of elements 27, 28 and 29. An open circuit voltage choice "open" in FIG. 4 is available for power control switch 12 but this choice during the Off period needs the added complexity of catch diodes to correctly drive any output filter inductance.

3) To generate a negative smooth DC track voltage between digital encoding bursts, filter switch 26 is in the position shown in FIG. 4, and power control switch 12 is rapidly switched between the two voltage source choices shown as −V for On and 0V for Off to generate a PWM controlled DC voltage in a similar manner as the positive DC is generated.

Impedance of element 11 in the 0V voltage source choice is typically low impedance or a short circuit, and can operate as described the in FIG. 2 discussion. If the track voltage is not required to be smoothed DC, then the output filter and filter switch 26 can be deleted, but the DC PWM frequency must be chosen to not cause a problem with decoder 16 discriminating digital signals.

The alternative FIG. 4 embodiment permits using the new mixed-mode control method within a single integrated unit, and operates decoder 16 and track 14 in the same manner as the embodiment of FIG. 2. DC speed and direction control is now by variable PWM track voltage control and is actuated by the user directly as an input (e.g. a rotary knob, slider knob, or speed up/down keys) to digital control element 21 and no external DC power control system, 10, is required. In this mode any non-decoder equipped conventional locomotive such as locomotive 19 will see essentially smooth DC (as it was designed to operate with) due to the action of output filter switch 26 and associated filter circuitry, and a digital equipped locomotive such as 15 will operate at a similar speed and direction but also now have digital control expansion such as sound, etc.

FIG. 5 shows an embodiment of a control unit that employs only the DC voltages from a DC power control system, 10. The output control voltage from DC power control system, 10, is conducted by two output wires 34 to digital control element 21 to provide operating power. Digital control element 21 can detect the input voltage conducted by output wires 34, and has additional control inputs; such as user switches 31 and 32 or similar means, and creates a bias voltage line 35 that is always more positive than the voltages on output wires 34 (i.e. lines 42 and 45). Bias voltage line 35 is also greater in voltage magnitude by at least the ON threshold voltage required by any output power switch elements, and can operate with either detected voltage polarity on the two output wires 34. The ON control transistor 37 and OFF control transistor 36 are connected with control lines operated by digital control element 21 which is the means to implement the mixed-mode encoding algorithm, rules and logic for generating the mixed-mode command strategy.

When line 42 is the positive input voltage, if ON control transistor 37 is activated by digital control element 21 to provide current, a positive control voltage will occur to turn an output power switch element, N-channel mosfet 38, ON and also operate N-channel mosfet 39 in the third quadrant low-loss rectifier mode. With elements 38 and 39 now both able to conduct current in series, the positive voltage on line 42 will be passed via output connection 13 to track 14 and can control locomotives. The relatively more negative voltage on line 45 is connected unmodified via output connection 13 to the track 14. At this time, OFF control transistor 36 is kept non-conducting and so the turnoff resistor 44 will ensure N-channel mosfet 40 and 41 in parallel with the track voltage remain non-conducting.

When digital control element 21 deactivates ON control transistor 37, N-channel mosfet 38 becomes non-conducting due to turnoff resistor 43 discharging its gate control voltage. N-channel mosfet 39 will now operate as a body-diode rectifier, but no track current can pass because N-channel mosfet 38 is now off.

With the positive voltage from line 42 now interrupted to track 14, the snubber-network 22 will dampen any voltage swings due to current being turned off into any inductances on the tracks.

A better control strategy is to activate OFF control transistor 36 a defined time immediately after ON control transistor 37 is deactivated. This has the effect of turning on N-channel mosfet 40 and hence discharging the track voltage through the third-quadrant rectifying N-channel mosfet 41 as an effectively low-impedance short across the track voltage, to collapse the voltage to a minimum. This ensures any time encoded digital signal is selected between well-defined voltage levels.

This same control sequence works equivalently when line 45 is alternatively the most positive voltage, as the other DC track direction control, and now the series N-channel mosfet 38 operates as a third quadrant rectifier and N-channel mosfet 39 operates as a controllable switch, in juxtaposition from the other operating input polarity.

These configurations are well known mosfet bilateral switches, now configured to switch the track voltage in time between the input voltage and a track low impedance short to encode digital control signals on the DC input voltage, as shown in periods t10 to t11 or t13 to t14 in FIG. 2. The combination of N-channel mosfets shown in FIG. 5 is thus a SPDT variation of the many possible power switch configurations that may be employed in this mixed-mode control invention.

ON control transistor 37 and OFF control transistor 36 operate the same way for either input voltage polarity, because the positive bias voltage line 35 that is generated within the digital control element 21 means is arranged to be always a more positive voltage than either line 42 or 45 and of high enough voltage to ensure the switch transistors can be turned on properly. Digital control element 21 in FIG. 5 now simply controls the sequencing of the ON control transistor 37 and OFF control transistor 36 to obtain the desired track voltage waveforms, and ensures these two control transistors are not on at the same time, which would have the effect of short circuiting the input voltage. Additionally these two control transistors may be implemented with bipolar or mosfet technology, and the polarity of the power switching bilateral mosfets may be changed to P-channel devices and the control voltages modified accordingly. Other combinations of power control devices are possible with simple circuit modifications to allow for different control characteristics.

For simplicity, the graphs in FIGS. 1, 2 and 3 show conventional DC power control system track control voltages. It is possible to easily expand the mixed-mode control methods taught here for distinctly different conventional AC power control systems by simply using a conventional AC control unit for item 10, and noting that because digital control element 21 necessarily works with either input voltage polarity and can automatically sense the magnitude and polarity of this input voltage, it can then determine that conventional AC power control is in effect and hence encode any digital control signals in a timed portion of the AC power cycle when there is sufficient track voltage magnitude to be detected by decoder 16.

With this modification, these mixed-mode methods may be employed on either conventional AC or DC power control systems. In this way, the times t7 to t14 of the graph in FIG. 2 can be interpreted in a distinctly different manner as being located in parts of successive cycles of an AC power waveform, instead of a strictly DC power waveform with a direction change.

A number of other functional elements such as power management and control logic in digital control element 21, and gate protection for the N-channel mosfets and other electrical details and arrangements are omitted from FIG. 5 as they add complexity to the diagram and are known to those skilled in the art of layout control system and electrical circuit design and may be configured from the details taught herein. This embodiment may be easily modified into any of the more complex configurations taught earlier, by recognizing that pairs of bilateral connected mosfets are operated as simple ON-OFF switches that may be combined into more complex voltage and current switching arrangements.

Mixed-Mode Control Algorithm for Decoding:

FIG. 6 shows a control algorithm that allows the control function in the decoder 16 to correctly operate on a layout with mixed-mode control. This algorithm is only a fraction of the total control logic or software that is employed to animate the control in a decoder 16. The balance of the many variations of decoder control algorithms known to those skilled in the art of decoder design are not shown here, since they are not necessary for the operation of mixed-mode conversion. The overall control logic may be formed by any combination of hardware logic and logic performed in software or firmware implemented on a processor unit.

Item 46 represents the state that the control algorithm reaches when any stimulus that decoder 16 detects results in the determination that a new command could have been encoded. A subsequent decision is made at item 47 as to whether the new command detected is in the same mode as the current operating mode, or is in a different or mixed-mode. If the implied mode of the new command is the same as currently in effect, then mixed-mode is not detected, and the command is effectively decoded at item 50 as a normal command for the current operating mode.

If item 47 detects a new command that implies a different control mode, then a decision is made at item 48 as to whether this command should be processed as a mixed-mode command and be effectively executed by item 50 or alternately this command should then cause item 49 to execute this as a control mode change.

The mixed-mode decision at item 48 can also have a number additional decision logic chains or rules, for example it may only permit function commands such as those for sound control to operate in mixed mode, but speed and direction commands will force a mode change. In this way, it is possible to setup predetermined rules to provide a useful and unique mixed-mode control strategy for many combinations of control modes and types of control.

Note that item 50 is the point where encoded commands are effectively decoded. This means that commands are decoded based on the required effects and type of control mode used for that command. For example, with a DCC controlled locomotive direction is encoded as a control bit in a digital command, whereas in a DC control mode the direction is effectively encoded in the polarity of the track voltage seen by decoder 16. For an AC controlled unit such as an older style Marlin conventional locomotive, a high voltage AC pulse commands a direction change.

When the input command is decoded within the context of the control mode, at item 50, it will lead to one of a number of task execution strategies such as; item 51 which will execute a speed and/or direction modification, item 52 which will execute a function control command, and item 53 that will decode and execute any commands not recognized as being for items 51 and 52. Note that the algorithm shown in FIG. 6 may be re-arranged in a number of different ways, but the important point is that the minimum required control elements and logic be present in some form and cooperate in a manner that ensure a correctly operating mixed-mode decoding algorithm.

Having thus disclosed the preferred embodiment and some alternatives to this embodiment, additional variations and applications for this invention will be apparent to those skilled in the art of decoder and electronic design, with minimal extra effort. Therefore, while the disclosed information details the preferred embodiment of the invention, no material limitations to the scope of the claimed invention are intended and any features and alternative designs that would be obvious to one of ordinary skill in the art are considered to be incorporated herein.

Consequently, rather than being limited strictly to the features disclosed with regard to the preferred embodiment, the scope of the invention is set forth and particularly described in the following attached claims.

What is claimed is:

1. A method for allowing a mixture of simultaneous and expanded command modes in a control system of a model railroad layout, comprising:

(i) providing a track connection connected to the model railroad layout to convey track command signals that control locomotives with decoders and locomotives without a decoder, (ii) configuring a digital decoder control logic mechanism to decode said track command signals that comprise a combination of a varying track voltage command mode and an added encoded command mode; wherein, the combination of the command modes forms the mixture of simultaneous and expanded command modes, (iii) configuring a mixed-mode control algorithm mechanism to employ mode decoding rules to analyze said command signals in said combination of the command modes, to decide whether to allow the mixed command modes to operate or to change command mode, to operate with concurrent mixed control signals, and to priortize and execute said command signals without conflict between the varying track voltage command mode and the added encoded command mode.

2. The method defined in claim 1, the varying track voltage command mode is provided by an AC control device.

3. The method defined in claim 2, wherein the encoded command mode is provided by a digital command control time encoding device.

4. The method defined in claim 1, wherein said varying track voltage command mode is provided by a DC control device.

5. The method defined in claim 4, wherein the encoded command mode provided by a digital command control time encoding device.

6. The method defined in claim 5, wherein voltages used for said digital command control time encoding device are constrained so as to not reverse a layout voltage polarity of said DC control device.

7. The method defined in claim 5 wherein said digital command control time encode device is NMRA DCC.

8. The method defined in claim 5 wherein voltages used for said digital command control time encoding device are not constrained by voltages of a control device for the varying track voltage command mode.

9. A method for providing a mixture of simultaneous and expanded command modes on a model railroad control system, comprising:

a) providing a power control system that conducts power having a command signal in a format of a varying track voltage command mode to an output voltage connection device, b) providing a control encoding mechanism communicating with said output voltage connection device, said control encoding mechanism includes (i) a digital control device capable of control logic and encoding for a new command mode, (ii) an additional control input device capable of conveying at least one new user command input to said digital control device that results in a new command encoded in a format of said new command mode, (iii) a power control switch device arranged under a control of said digital control device that is capable of modifying the varying track voltage command signal to further include an added said new command encoded in the format of said new command mode to form an output signal that is the mixture of simultaneous and expanded command modes, and communicating said output signal via a layout connection that connects to a model railroad layout, and said output signal controls locomotives with decoders and locomotives without a decoder, c) providing a decoder means that includes (i) a digital decoder control logic mechanism configured to decode said output signal, and (ii) a mixed-mode control algorithm mechanism configured to employ mode decoding rules to analyze said output signal in said combination of the command modes, to decide whether to allow the mixed command modes to operate or to change command mode, to operate with concurrent mixed control signals, and to priortize and execute said output signal without conflict between the varying track voltage command mode and the added encoded command mode.

10. The method defined in claim 9, wherein said varying track voltage command mode is provided by an AC control device.

11. The method defined in claim 10, wherein the format of said new command mode is provided by a digital command control time encoding device.

12. The method defined in claim 9, wherein said varying track voltage command mode is provided by DC control device.

13. The method defined in claim 12, wherein the format of said new command mode is provided by a digital command control time encoding device.

14. The method defined in claim 13, wherein said digital command control time encoding device is NMRA DCC.

15. The method defined in claim 12, wherein voltages used for said digital command control time encoding device are constrained so as to not reverse a layout voltage polarity of said DC control device.

16. The method defined in claim 12 wherein voltages used for said digital command control time encoding device are not constrained by voltages of said DC control device.

17. The method defined in claim 9, wherein said varying track voltage command mode is provided by a fixed power source and a variable PWM track voltage control device arranged under a user control, and a controllable output filter switch device with an associated filter circuitry is added to said control encoding mechanism to provide simultaneous mixed-mode DC and digital command control.

18. The method defined in claim 5 wherein a signal formatted in said encoded command mode is configured to selectively override a signal formatted in said varying track voltage command mode.

19. The method defined in claim 18 wherein said signal formatted in said encoded command mode and said signal formatted in said varying track voltage command mode are speed signals.

* * * * *